US007229045B2

(12) United States Patent
Bucher et al.

(10) Patent No.: US 7,229,045 B2
(45) Date of Patent: Jun. 12, 2007

(54) STORE CONTROL DEVICE AND SYSTEM FOR THE PREPARATION AND INTERMEDIATE STORAGE OF PAPER REELS AND FEEDING THEREOF TO AT LEAST ONE REEL STAND AND METHOD FOR ITS OPERATION

(75) Inventors: Pierre Bucher, Delemont (CH); Martial Frund, Courrendlin (CH); Walter Brandli, Laufen (CH)

(73) Assignee: Metso Paper AG, Delemont (CH)

( * ) Notice: Subject to any disclaimer, the term of this patent is extended or adjusted under 35 U.S.C. 154(b) by 0 days.

(21) Appl. No.: 10/938,550

(22) Filed: Sep. 13, 2004

(65) Prior Publication Data

US 2006/0049296 A1 Mar. 9, 2006

(30) Foreign Application Priority Data

Sep. 3, 2004 (EP) ..... 04020955

(51) Int. Cl.
*B65H 19/12* (2006.01)

(52) U.S. Cl. ..... 242/559; 242/560; 242/561; 414/911

(58) Field of Classification Search ..... 242/559, 242/559.1, 559.2, 559.3, 559.4, 560, 561, 242/533.2, 533.7; 414/911
See application file for complete search history.

(56) References Cited

U.S. PATENT DOCUMENTS 2,189,010 A * 2/1940 Lewis ..... 414/680
3,695,532 A * 10/1972 Lindstaedt ..... 242/561
4,131,206 A * 12/1978 Kawada et al. ..... 414/352
4,189,276 A * 2/1980 Shaffer ..... 414/659
4,553,893 A * 11/1985 Kaschner et al. ..... 414/152
4,610,404 A * 9/1986 Maccaferri ..... 242/473.7
4,863,335 A * 9/1989 Herigstad et al. ..... 414/495
4,948,060 A * 8/1990 Kurz et al. ..... 242/552
5,076,751 A * 12/1991 Kafka ..... 414/282
5,286,157 A * 2/1994 Vainio et al. ..... 414/273

(Continued)

FOREIGN PATENT DOCUMENTS

DE 8912231 U1 12/1989

(Continued)

*Primary Examiner*—Patrick Mackey
*Assistant Examiner*—William E. Dondero
(74) *Attorney, Agent, or Firm*—Oliff & Berridge PLC

(57) ABSTRACT

A store control device of an intermediate store carries, on a pivot mounting which is mounted on a chassis capable of travelling along a track, so as to be rotatable about a vertical axis through 360°, a pick-up device for a paper reel which has a continuous track section for holding a carriage loaded with a paper reel and raisable and lowerable claws arranged on both sides thereof. Storage tracks which are in the form of short stub tracks and have carriages and which form storage places for holding paper reels with axes oriented transversely to the track are arranged on both sides of the track. Before storage of a paper reel in the intermediate store, the pivot mounting is rotated so that the winding direction of the stored paper reel corresponds to a required value. The claws can also be formed so as to be longitudinally displaceable on both sides by at least a reel length, in which case only a support surface is provided between them and the storage places are equipped with stationary storage troughs.

19 Claims, 7 Drawing Sheets

U.S. PATENT DOCUMENTS 6,155,516 A * 12/2000 Lehrieder et al. ..... 242/559.3

FOREIGN PATENT DOCUMENTS

| | | | |
|---|---|---|---|
| DE | 29700874 | U1 | 7/1997 |
| EP | 0 950 625 | A2 | 10/1999 |
| EP | 1 156 979 | B1 | 11/2001 |
| EP | 1 245 524 | A2 | 10/2002 |
| EP | 1 329 397 | A1 | 7/2003 |
| EP | 1 382 561 | A1 | 1/2004 |
| WO | WO 89/04284 | A1 | 5/1989 |
| WO | WO 9317946 | A1 * | 9/1993 |
| WO | WO 98/12132 | A1 | 3/1998 |
| WO | WO 00/51931 | A1 | 9/2000 |
| WO | WO 00/68115 | | 11/2000 |

* cited by examiner

STORE CONTROL DEVICE AND SYSTEM FOR THE PREPARATION AND INTERMEDIATE STORAGE OF PAPER REELS AND FEEDING THEREOF TO AT LEAST ONE REEL STAND AND METHOD FOR ITS OPERATION

FIELD OF THE INVENTION

The invention relates to a store control device and a system comprising such a device and intended for the preparation and intermediate storage of paper reels and feeding thereof to at least one reel stand. Systems of this type are used in reel cellars of printing works for supplying the printing presses with paper. The invention also relates to a method for operating the system.

PRIOR ART

Store control devices of the generic type are known, which devices carry, as a pick-up device, rails for holding a store vehicle which travels from the chassis into store channels and can pick up or deposit a paper reel in each case at a storage place there. Such store vehicles have support surfaces which serve for holding the paper reel and can be raised and lowered for lifting or setting down said paper reel. EP 1 382 561 A1 discloses such a store control device in which the pick-up device also has raisable and lowerable claws which are extendable on both sides transversely to the direction of travel of the chassis.

By means of this store control device, however, the paper reel cannot be turned about a vertical axis. An adjustment of the winding direction of a paper reel to a required value is consequently not possible, so that additional complicated and bulky devices, such as, for example, turntables, are required for this purpose.

WO 89/04 284 A1 discloses a store control device comprising a store vehicle which has, on a chassis, a pivot mounting which carries the rail for holding the store vehicle. However, the pivot mounting serves only for aligning the store vehicle so that it can travel in store channels on both sides of the track along which the store control device is capable of travelling, with a fork-like holder for the paper reel in front, since only in this way can it pick up or set down a paper reel. With this store control device, too, adjustment of the direction of winding of a paper reel is consequently not possible since the alignment of the pivot mounting must be in accordance with the required orientation of the store vehicle. Furthermore, the chassis does not carry raisable and lowerable claws, so that lifting of paper reels from the simple carriages usually used in reel cellars and not having a raisable and lowerable support surface is not possible. The transfer of a paper reel from such a carriage to the store control device, and vice versa, is therefore not directly possible.

WO 98/12 132 describes a store control device comprising a continuous track section on a pivot mounting, on which carriages of the type usually used in reel cellars can travel. The pivot mounting evidently serves only for aligning the carriages which travel on from a track connecting to a top end of the track of the store control device and then, after movement of the store control device, have to travel into a track of an intermediate store, which track runs transversely to the track of said store control device. An adjustment of the direction of winding of the paper reel by means of the pivot mounting is evidently not intended and is also not required since fixed turntables are present, on which such a step can be performed. A device by means of which the paper reel on the store control device could be lifted off the carriage is not present. The paper reel is loaded onto a carriage at a preparation station and remains in the intermediate store until picked up by the reel stand. This requires the carriages to return in the opposite direction or over additional tracks and complicates the control or the design of the system, or both.

SUMMARY OF THE INVENTION

It is the object of the invention to provide a store control device which offers the possibility of adjusting the direction of winding of paper reels to a required value and which furthermore permits the picking up of paper reels from simple carriages and the transfer of paper reels to such carriages. This makes it possible to construct systems comprising intermediate stores in a very simple manner without turntables and additional tracks for the return of carriages and similar relatively expensive and bulky devices and also to keep their control simple, so that no unexpected difficulties occur during operation. A corresponding system and a method for its operation likewise belong to the scope of the invention.

BRIEF DESCRIPTION OF THE DRAWINGS

Below, the invention is explained in more detail with reference to figures which only show embodiments.

DESCRIPTION OF THE PREFERRED EMBODIMENTS

Figure 1:
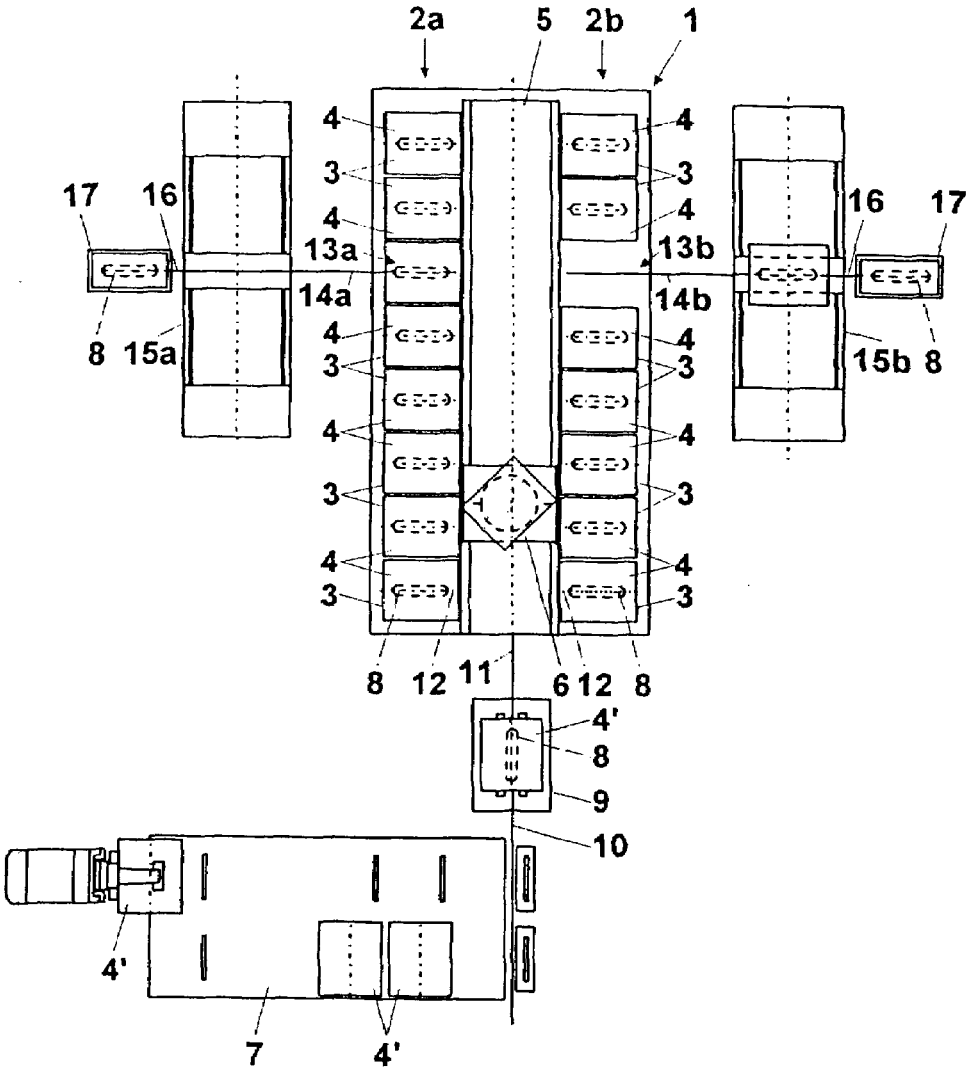
FIG. 1 shows a plan view of a first embodiment of a system according to the invention.

The system according to the invention has (FIG. 1) an intermediate store 1 comprising two parallel rows 2*a,b* of storage places 3 which run in a longitudinal direction and on which prepared paper reels 4 can be stored horizontally with axes aligned in a transverse direction transverse to the longitudinal direction, and a track 5 running between said rows and along which the store control device 6 is capable of travelling. The intermediate store 1 serves in particular as a buffer store which permits interruptions to work during reel preparation while printing continues.

Arranged in the entrance region is a ramp 7 from which packed paper reels 4' delivered from a main store can be rolled by means of a clamp stacker as required onto a carriage 8 of known design and can be fed to a preparation station 9 and further to the intermediate store 1. A feed track 10 on which the carriage 8 travels leads in the longitudinal direction from the end of the ramp 7 via the preparation station 9 to a pick-up position 11 at the end of the track 5.

The storage places 3 each have storage tracks 12 which are in the form of short stub tracks emanating from the track 5 and on which in each case a carriage 8 is parked, which carriage carries the prepared paper reel 4. Each of the two rows 2*a,b* of storage places 3 is interrupted by a transfer position 13*a,b*. Emanating from the transfer positions 13*a,b* opposite one another, in the transverse direction, are supply tracks 14*a,b* which lead to two reel stands 15*a;b* arranged on both sides of the intermediate store 1 and having unwinding axles aligned in the transverse direction and moving platforms having track sections which are continuous in the transverse direction. A parking track 16 which is in the form of a stub track and can hold a carriage 8 which is loaded with a reel core basket 17 is arranged on the opposite side of the reel stand 15*a,b* each case in the continuation of the supply track 14*a,b*.

Figure 2:
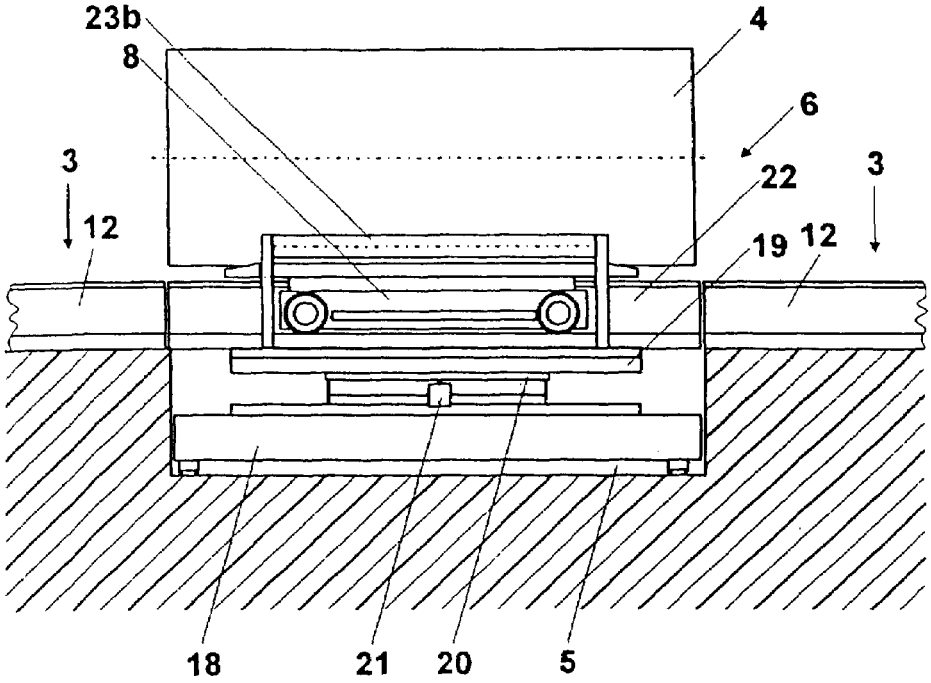
FIG. 2 shows a front view of a first embodiment of a store control device according to the invention, with a paper reel loaded, in a ground state.
Figure 3:
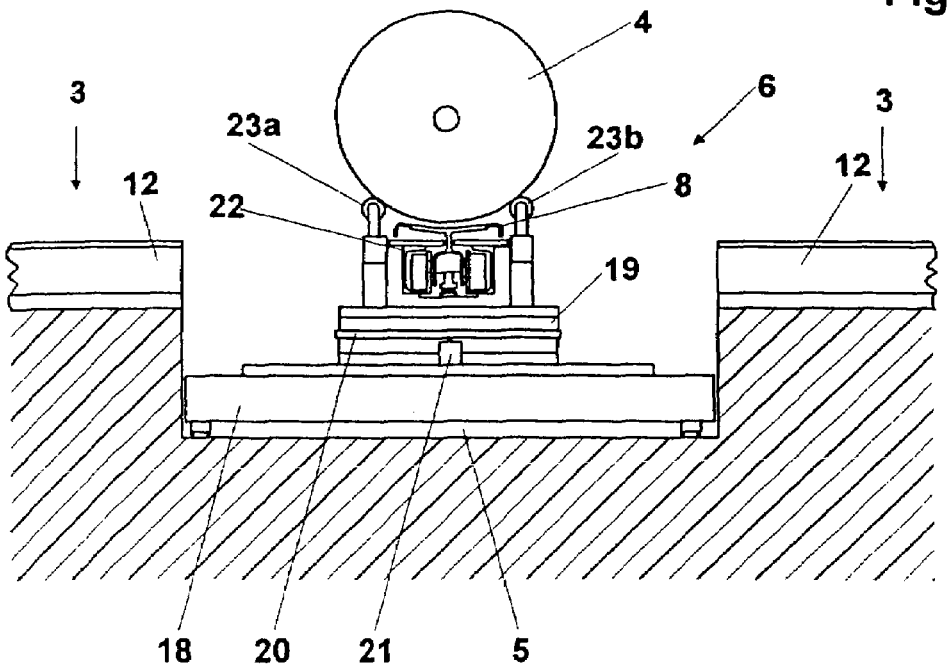
FIG. 3 shows a front view corresponding to FIG. 2 but with a pivot mounting rotated through 90°.

The store control unit 6 according to a first embodiment (FIG. 2, 3) has a chassis 18 which is capable of travelling on rails along the track 5 and on which a pivot mounting 19 is mounted so as to be rotatable through 360° about a vertical axis. It can be driven by means of a motor 21 via a toothed belt 20. The pivot mounting 19 comprises a pick-up device for a paper reel 4 which comprises a centrally arranged continuous track section 22 which can hold a carriage loaded with the paper reel 4. On both sides of the track section 22, the pick-up device has two elongated, raisable and lowerable claws 23*a,b* which are arranged parallel and by means of which the paper reel 4 can be lifted, in particular lifted off the carriage 8.

The system is controlled by a material flow computer. In operation, the intermediate store 1 is filled with prepared paper reels 4 during a work phase. For this purpose, in each case a packed paper reel 4' is loaded, at the end of the ramp 7, onto a carriage 8, which brings it via the feed track 10 to the preparation station 9, where it is lifted off the carriage 8, unpacked manually and provided with an adhesive area, i.e. is completely prepared, while the carriage 8 travels back to the ramp 7. During the preparation of the paper reel 4, its winding direction is also determined and is input into the material flow computer.

The prepared paper reel 4 is then placed on a further carriage 8 which travels on to the pick-up position 11. The store control device 6 stands, with pivot mounting 19 being rotated through 90°, at that end of the track 5 which abuts the pick-up position 11, so that the track section 22 connects flush with the feed track 10. The carriage 8 travels onto the track section 22, whereupon the claws 23*a,b* are raised and the paper reel 4 is lifted off the carriage 8. The carriage 8 then travels back onto the feed track 10 and can subsequently receive a further prepared paper reel 4 at the preparation station 9.

The winding direction of the paper reel 4 is now checked by the material flow computer. Depending on the result, the pivot mounting 19, driven by the motor 21, performs a rotation through 90° in the counterclockwise direction or the clockwise direction so that the winding direction of the stored paper reel 4 then corresponds in each case to the required value. At the same time, the store control device 6 is moved over the track 5 next to the storage place 3 provided for the paper reel 4, so that the track section 22 is flush with the storage tracks 12 of the intended storage place 3 and of the storage place 3 opposite it and connects thereto. An empty carriage 8 parked on the storage track 12 then travels onto the track section 22, whereupon the claws 23*a,b* are lowered and the paper reel 4 is thus set down on the carriage 8. The carriage 8 now travels from the track section 22 of the store control device 6 onto the storage track 12 of the intended storage place 3. The process is as a rule repeated until the intermediate store 1 has been filled with prepared paper reels 4.

Even if the work at the preparation station 9 comes to a stop, prepared paper reels 4 from the intermediate store 1 are fed as required to the reel stands 15*a,b*. For feeding an intended paper reel 4, for example to the reel stand 15*a*, the store control device 6 is moved next to its storage place 3, whereupon the carriage 8 carrying the paper reel 4 travels from the storage track 12 onto the track section 22 of the store control device 6. By raising the claws 23*a,b*, the paper reel 4 is in turn lifted off the carriage 8, which then travels back empty onto the storage track 12. The store control device 6 is then moved next to the transfer position 13*a*, where a carriage 8 is ready. The carriage 8 now travels onto the track section 22 of the store control device 6, whereupon its claws 23*a,b* are lowered and the paper reel 4 is set down on the carriage 8, which then travels again to the transfer position 13*a* and at the same time or subsequently over the supply track 14*a* further to the reel stand 15*a*, where it travels onto the moving platform, and the paper reel 4 is clamped. The empty carriage 8 is then moved back to the transfer position 13*a*, where it remains in the waiting position.

Figure 4A:
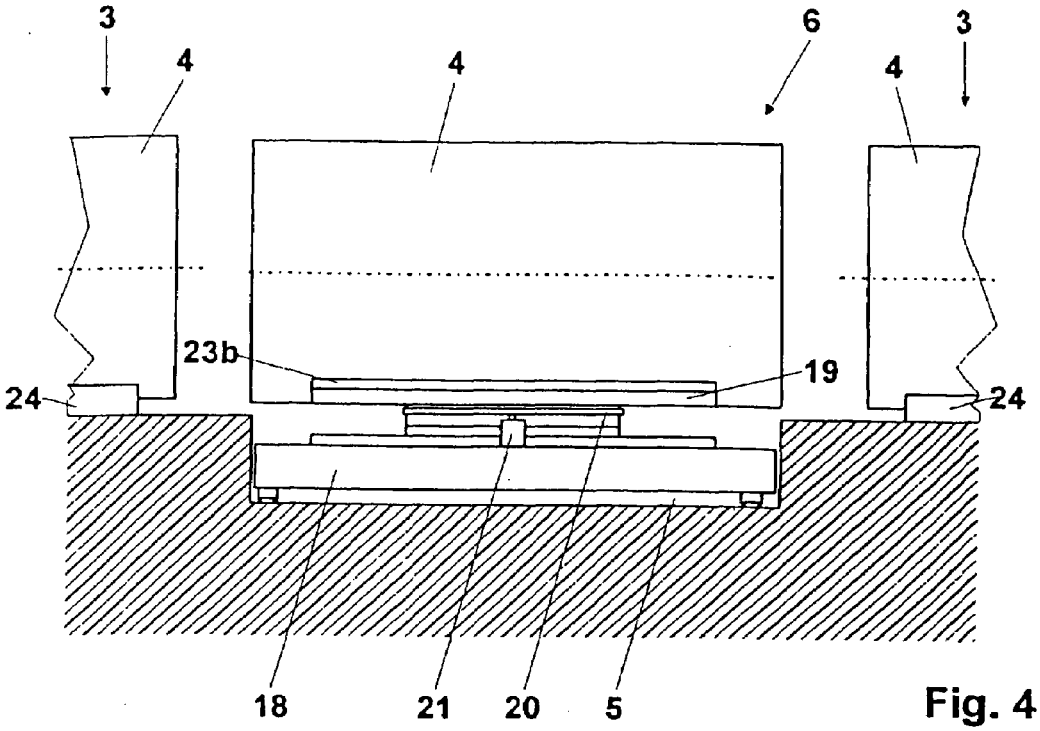
FIG. 4*a* shows a front view of a second embodiment of a store control device according to the invention, with a paper reel loaded, in the ground state.
Figure 4B:
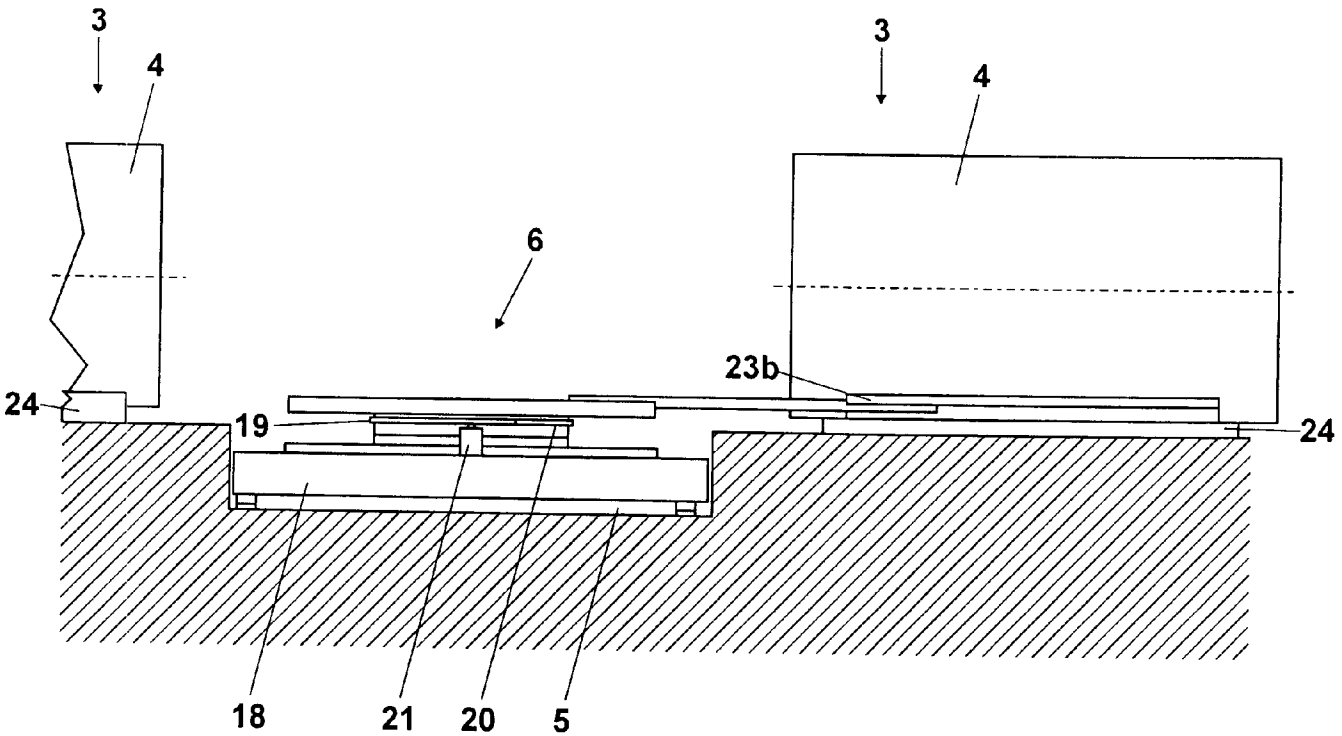
FIG. 4*b* shows a front view of a second embodiment of a store control device according to the invention, with the claws projecting longitudinally beyond the pivot mounting.
Figure 5:
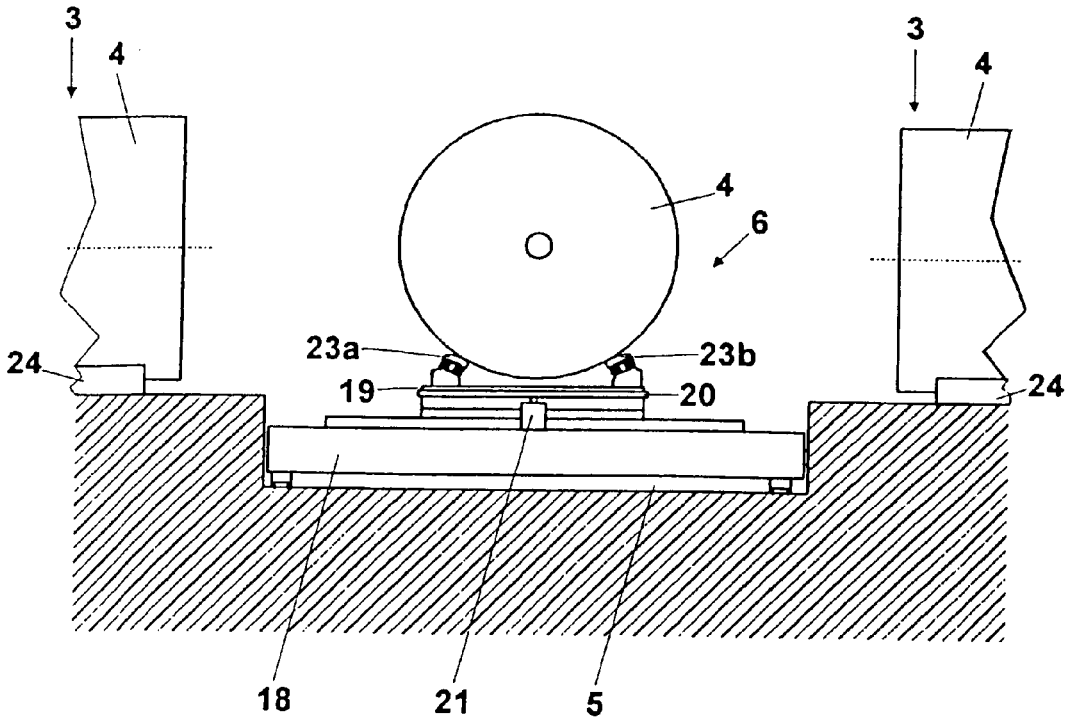
FIG. 5 shows a front view corresponding to FIG. 4*a* but with a pivot mounting rotated through 90°.

In a store control device 6 according to a second embodiment (FIG. 4*a*, 5), the pick-up device likewise has two elongated claws 23*a,b* which are arranged symmetrically and in parallel and can be raised and lowered. In a ground state of the store control device 6 (FIG. 4*a*), the claws 23*a,b* are located above the chassis 18. The store control device 6 can, however, assume two transfer states, in one of which the two claws 23*a,b* are moved in their longitudinal direction to one side and in the other of which they are moved in the longitudinal direction to the other side, in each case by slightly more than the length of the paper reel 4, so that they project far beyond the chassis 18. An example illustrating a transfer state is shown in FIG. 4*a*. In this case, the storage places 3 have stationary storage troughs 24 instead of storage tracks occupied by carriages.

The operation of the system according to the invention, comprising a store control device according to the second embodiment, does not differ fundamentally from the above description. The only difference is that, during pick-up and transfer of a paper reel by the store control device 6 from a carriage or to a carriage, the latter does not travel onto the pivot mounting 19 of the store control device 6—nor is a track section provided—but instead merely travels next to the store control device 6, which then assumes its transfer state with advanced, lowered or raised claws 23*a,b* which project beyond the carriage 8 and are then raised for picking up a paper reel 4 from the carriage 8 or lowered for setting down a paper reel 4 on the carriage 8, and are then retracted by virtue of the fact that the store control device 6 assumes the ground state again. The setting down of a paper reel 4 on the storage trough 24 of the intended storage place 3 and the picking up of such a paper reel 4 from said storage trough 24 are effected in the same way.

Figure 6:
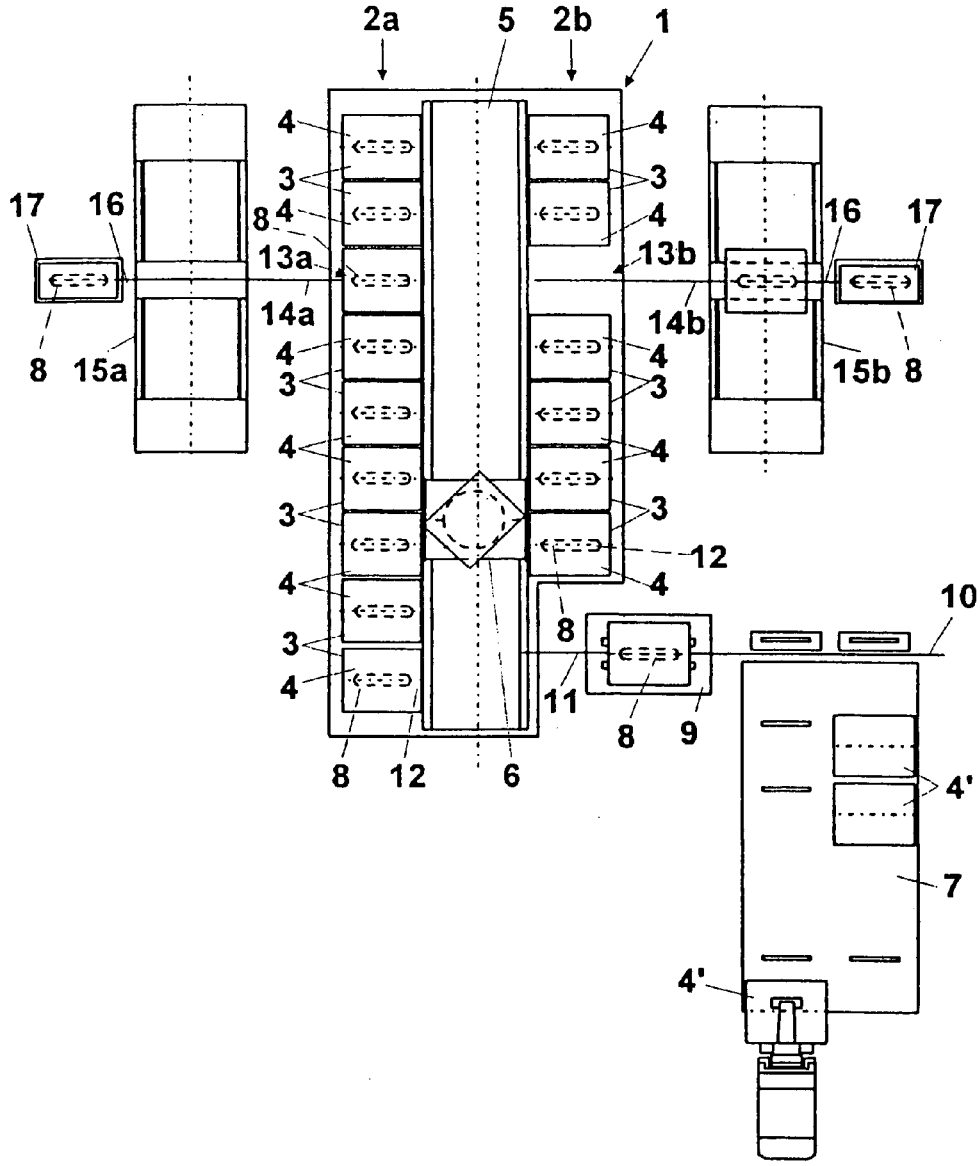
FIG. 6 shows a plan view of a second embodiment of a system according to the invention and FIG. 7 shows a front view of a third embodiment of a store control device according to the invention, with a paper reel loaded, with raised pick-up device.

According to a second embodiment of the system according to the invention, which differs slightly from the first one, the ramp 7 is (FIG. 6) oriented in a longitudinal direction while the feed track 10 runs in the transverse direction and abuts the track 5 laterally, where space has been left therefor by transfer of two storage places from row 2*b* to row 2*a*. The operation of this system corresponds almost completely to the description above in relation to the first embodiment. The only difference is that, during picking up of a paper reel 4 by the store control device 6, the pick-up device is oriented transversely. Depending on the winding direction of the paper reel 4, no rotation of the pivot mounting 19 is effected or a rotation through 180° is effected in such a way that the winding direction of the stored paper reel 4 in turn corresponds to the required value.

If the required value of the winding direction for the paper reels 4 is independent of the method of their use, the paper reels 4 can all be stored in the intermediate store 1 with the same winding direction corresponding to the required value, which increases the clarity and facilitates the management of the intermediate store 1. It is of course also possible in every case to store the paper reels without any order in this context and, where necessary, to bring the winding direction of the paper reel into correspondence with the required value only on removal of the paper reel from the store, by rotation of the pivot mounting 19 of the store control device 6 through 180°.

Figure 7:
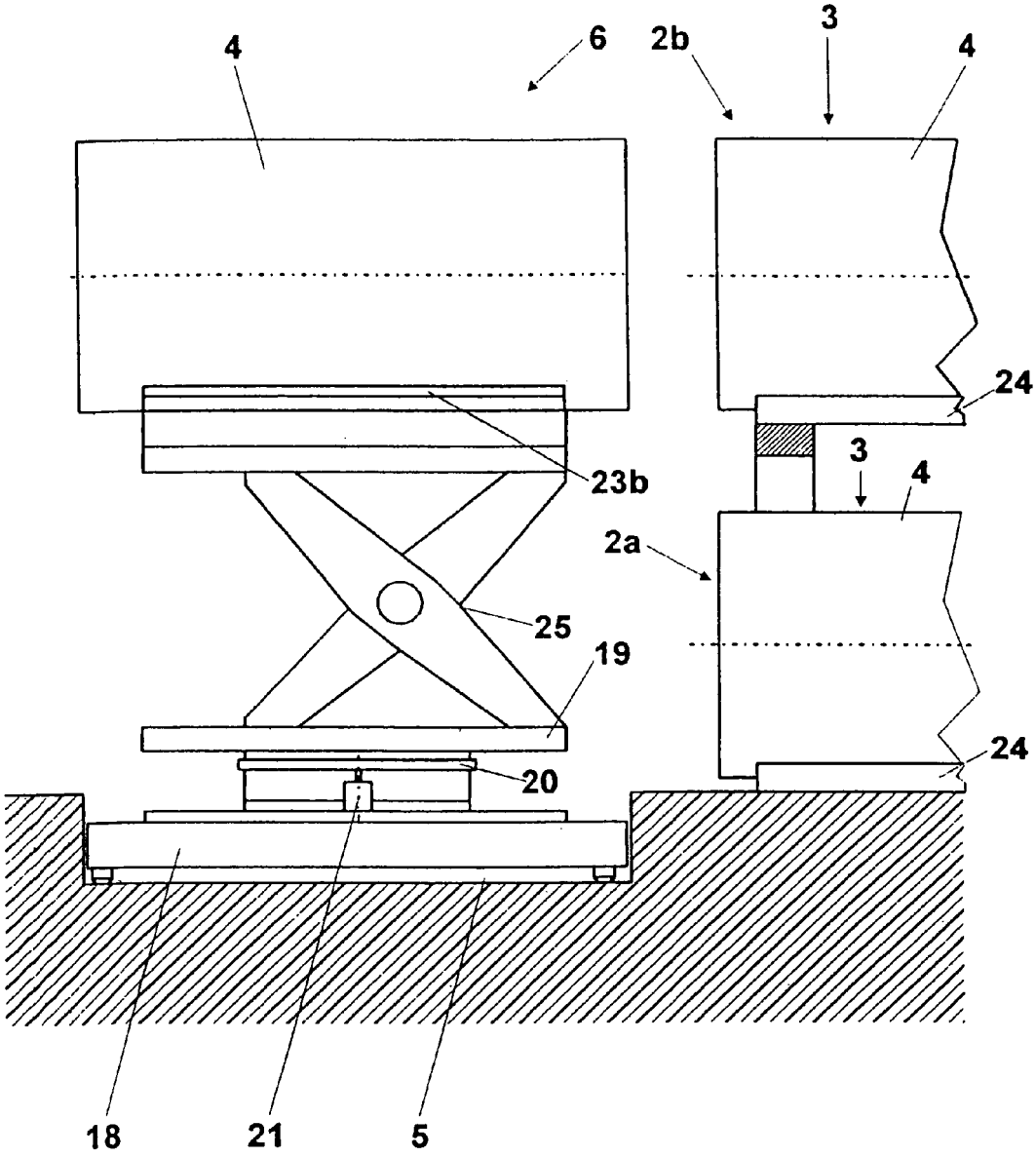

The intermediate store 1 may also be (FIG. 7) in the form of a high-bay store having two—possibly also more—rows 2*a,b* of storage places 3 one on top of the other and equipped with storage troughs 24. In this case, the store control device 6 has a lifting device which is arranged on the pivot mounting 19 and, for example, is in the form of a pantograph 25 and which carries the pick-up device so that the latter is adjustable in height over an adjustment range which includes the lower and the upper row, i.e. extends over more than the diameter of one paper roll. The pick-up device can be formed as described in relation to the second embodiment of the store control device 6.

LIST OF REFERENCE SYMBOLS

1 Intermediate store
2*a,b* Rows
3 Storage place
4, 4' Paper reel
5 Track
6 Store control device
7 Ramp
8 Carriage
9 Preparation station
10 Feed track
11 Pick-up position
12 Storage track
13*a,b* Transfer position
14*a,b* Supply track
15*a,b* Reel stand
16 Parking track
17 Reel core basket
18 Chassis
19 Pivot mounting
20 Toothed belt
21 Motor
22 Track section
23*a,b* Claws
24 Storage trough
25 Pantograph

The invention claimed is:

1. A movable storage and retrieval device for storing paper reels and removing them from storage, comprising:

a movable chassis;

a pivot mounting mounted on top of the chassis; and a pick-up device for picking up a paper reel, the paper reel disposed horizontally with respect to its axis of rotation, the pick-up device being mounted on top of the pivot mounting and being rotatable about a vertical axis by at least 180°, and the pick-up device having two elongated claws that are raisable and lowerable relative to the pivot mounting, spaced a distance apart from each other, and movable between upper and lower positions relative to the chassis for raising and lowering the paper reel.

2. The storage and retrieval device according to claim 1, wherein the pick-up device is rotatable about the vertical axis through 360°.

3. The storage and retrieval device according to claim 1, wherein the pick-up device comprises a continuous track section arranged between the claws and intended for holding a carriage.

4. The storage and retrieval device according to claim 1, wherein the claws are movable from a ground state position, in a longitudinal direction into opposite transfer positions in which they project longitudinally beyond the pivot mounting on opposite sides, in each case for taking up or depositing a paper reel.

5. The storage and retrieval device according to claim 4, wherein in the transfer positions, the claws project beyond the pivot mounting by at least the length of one paper reel.

6. The storage and retrieval device according to claim 1, wherein the pick-up device can be raised and lowered relative to the chassis over an adjustment range.

7. The storage and retrieval device according to claim 6, wherein the adjustment range extends at least over the diameter of one paper reel.

8. A system for the preparation and intermediate storage of paper reels and feeding thereof to at least one reel stand, comprising:

a movable storage and retrieval device for storing paper reels and removing them from storage, the storage and retrieval device comprising a movable chassis;

a pivot mounting mounted on top of the chassis; and a pick-up device for picking up a paper reel, the paper reel disposed horizontally with respect to its axis of rotation, the pick-up device being mounted on top of the pivot mounting and being rotatable about a vertical axis by at least 180°, and the pick-up device having two elongated claws that are raisable and lowerable relative to the pivot mounting, spaced a distance apart from each other, and movable between upper and lower positions relative to the chassis for raising and lowering the paper reel;

an intermediate store having at least one row of storage places arranged side by side and intended for holding in each case a paper reel with its axis oriented in a transverse direction transversely to a longitudinal direction, said row extending in the longitudinal direction, a preparation station and a feed track which leads from said preparation station to a pick-up position, and a supply track which, leading away from a transfer position, runs in the transverse direction to the reel stand, wherein the intermediate store includes a track which runs in the longitudinal direction and which leads past each of the storage places, to the pick-up position and to the transfer position and over which the storage and retrieval device can travel.

9. The system according to claim 8, wherein the intermediate store has in each case at least one row of storage places at least on each side of the track.

10. The system according to claim 8, wherein the transfer position is arranged in a row with a row of storage places and is oriented in the transverse direction.

11. The system according to claim 8, wherein the pick-up position is arranged in a row with a row of storage places and is oriented in the transverse direction.

12. The system according to claim 8, wherein the pick-up position is arranged at one end of the track and is oriented in the longitudinal direction.

13. The system according to claim 8, wherein the claws are movable from a ground state position, in a longitudinal direction into opposite transfer positions in which they project longitudinally beyond the pivot mounting on opposite sides, in each case for taking up or depositing a paper reel, and each of the storage places is provided with a stationary storage trough oriented in the transverse direction.

14. A system for the preparation and intermediate storage of paper reels and feeding thereof to at least one reel stand, comprising:

a movable storage and retrieval device for storing paper reels and removing them from storage, the storage and retrieval device comprising a movable chassis;

a pivot mounting mounted on top of the chassis; and a pick-up device for picking up a paper reel, the paper reel disposed horizontally with respect to its axis of rotation, the pick-up device being mounted on top of the pivot mounting and being rotatable about a vertical axis by at least 180°, and the pick-up device having two elongated claws that are raisable and lowerable relative to the pivot mounting, spaced a distance apart from each other, and movable between upper and lower positions relative to the chassis for raising and lowering the paper reel, wherein the pivot mounting can be raised and lowered relative to the chassis over an adjustment range, and the adjustment range extends at least over the diameter of one paper reel;

an intermediate store having a first row of storage places arranged side by side and intended for holding in each case a paper reel with its axis oriented in a transverse direction transversely to a longitudinal direction, said row extending in the longitudinal direction, a preparation station and a feed track which leads from said preparation station to a pick-up position, and a supply track which, leading away from a transfer position, runs in the transverse direction to the reel stand, wherein the intermediate store includes a track which runs in the longitudinal direction and which leads past each of the storage places, to the pick-up position and to the transfer position and over which the storage and retrieval device can travel, and a second row of storage places, wherein the first and second rows of storage places are arranged one on top of the other.

15. A system for the preparation and intermediate storage of paper reels and feeding thereof to at least one reel stand, comprising:

a movable storage and retrieval device for storing paper reels and removing them from storage, the storage and retrieval device comprising a movable chassis;

a pivot mounting mounted on top of the chassis; and a pick-up device for picking up a paper reel, the paper reel disposed horizontally with respect to its axis of rotation, the pick-up device being mounted on top of the pivot mounting and being rotatable about a vertical axis by at least 180°, and the pick-up device having two elongated claws that are raisable and lowerable relative to the pivot mounting, spaced a distance apart from each other, and movable between upper and lower positions relative to the chassis for raising and lowering the paper reel;

an intermediate store having at least one row of storage places arranged side by side and intended for holding in each case a paper reel with its axis oriented in a transverse direction transversely to a longitudinal direction, said row extending in the longitudinal direction, a preparation station and a feed track which leads from said preparation station to a pick-up position, and a supply track which, leading away from a transfer position, runs in the transverse direction to the reel stand, wherein the intermediate store includes a track which runs in the longitudinal direction and which leads past each of the storage places, to the pick-up position and to the transfer position and over which the storage and retrieval device can travel, wherein the pick-up device comprises a continuous track section arranged between the claws and intended for holding a carriage, and each of a plurality of storage places is provided with a storage track oriented in the transverse direction, and the track section of the storage and retrieval device is adjustable in each case at the plurality of storage places and at the pick-up position and at the transfer position so that it connects flush with the corresponding storage track, the feed track or the supply track.

16. A method for operating a system according to claim 8, in which the paper reels are prepared in the preparation station, stored in the intermediate store and removed therefrom as required and fed to a reel stand, the winding direction of each paper reel being brought into correspondence with a predetermined value either during storage or during removal from storage, where necessary, by corresponding rotation of the pivot mounting of the storage and retrieval device through 180°.

17. The method according to claim 16, wherein the rotation of the paper reel is effected during storage, so that the winding direction of the paper reels in the intermediate store always corresponds to the predetermined value.

18. The method according to claim 16, wherein all paper reels in the intermediate store have the same winding direction.

19. The method according to claim 16, wherein a paper reel, provided with an adhesive area, is in each case loaded onto a carriage at the preparation station, said carriage is moved to the pick-up position and the paper reel is lifted off the carriage there by the storage and retrieval device, whereupon the storage and retrieval device is moved next to the storage place provided for the paper reel, where the paper reel is stored and, if required, the storage and retrieval device is subsequently moved again next to the storage place, the paper reel is picked up by the storage and retrieval device, and the storage and retrieval device is moved to the transfer position, where the paper reel is set down on a further carriage which brings it to the reel stand.

* * * * *